US005567895A

United States Patent [19]

Aspri et al.

[11] Patent Number: 5,567,895

[45] Date of Patent: Oct. 22, 1996

[54] SOUND REVERBERATOR MOUNTED IN A SOUND BOX OF A STRING MUSICAL INSTRUMENT

[76] Inventors: Roberto Aspri, 12145 de l'Acadie, Montreal, Quebec, Canada, H3M 2V1; Claude Mauffette, 4641 Melrose, Montreal, Quebec, Canada, H4A 2S8

[21] Appl. No.: 501,375

[22] Filed: Jul. 12, 1995

Related U.S. Application Data

[63] Continuation-in-part of Ser. No. 401,234, Mar. 9, 1995, abandoned.

[51] Int. Cl.[6] ..... G10D 3/02

[52] U.S. Cl. ..... 84/294; 84/295; 84/297 R

[58] Field of Search ..... 84/294, 291, 292, 84/267, 268, 269, 274, 275, 276, 277, 312 R, 313, 297 R, 295

[56] References Cited

U.S. PATENT DOCUMENTS 1,588,730 6/1926 Hessel ..... 84/295

3,623,390 11/1971 Pitt ..... 84/294

4,984,493 1/1991 Schaller ..... 84/313

*Primary Examiner*—Cassandra C. Spyrou

[57] ABSTRACT

A sound reverberator for a string musical instrument having a sound box and strings tensioned over a saddle member of a bridge piece connected to a top wall of the sound box. The reverberator comprises one or more pre-tensioned springs secured internally of the sound box. A metallic transfer member is secured to a free end of the spring internally of the sound box. The transfer member is displacedly supported under the strings by a finger actuated displaceable support element for releasably engaging the springs of the musical instrument to transfer vibrations from the strings to the one or more metal springs whereby to produce sound vibrations internally of the sound box to modify the tonality of the sound generated by the sound box as a result of setting the strings in vibration.

14 Claims, 6 Drawing Sheets

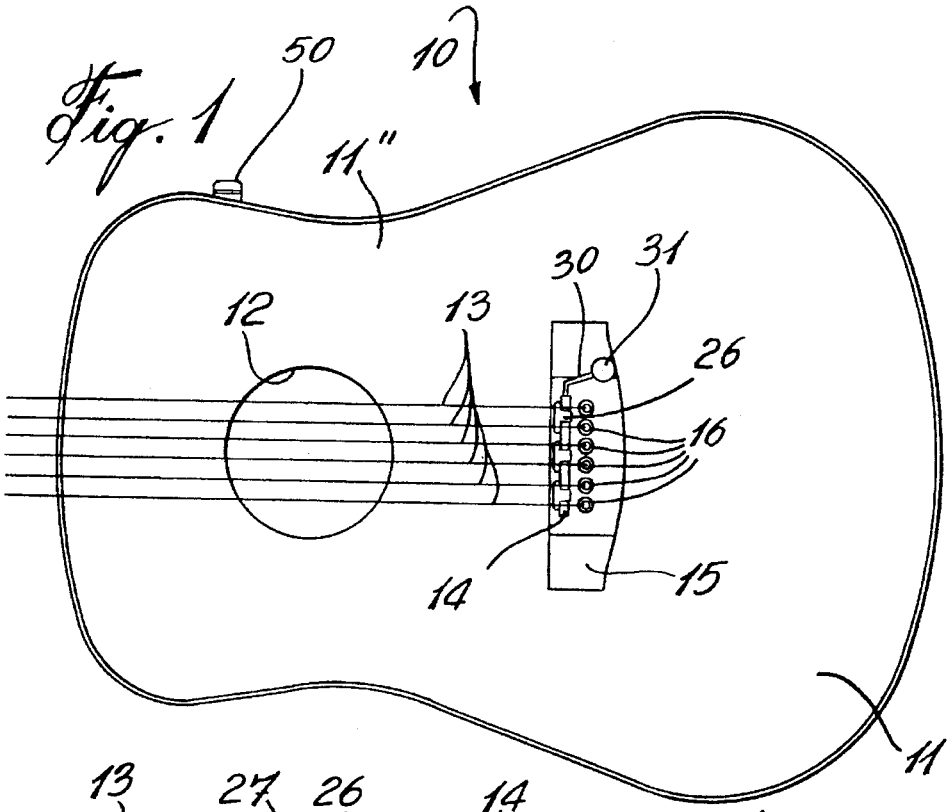
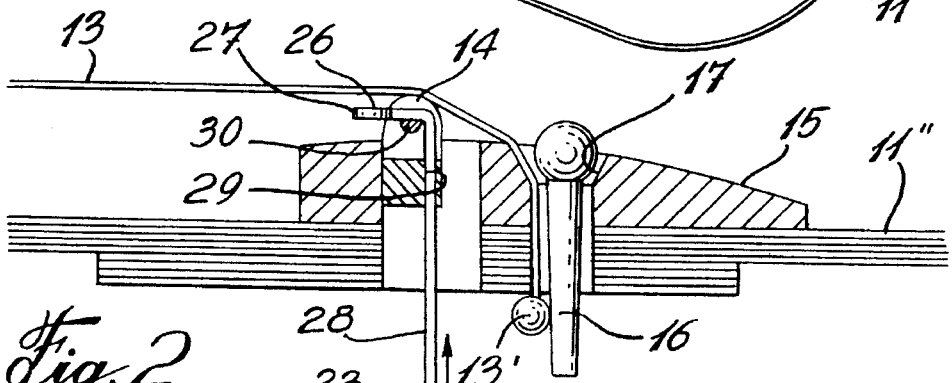
Fig. 2
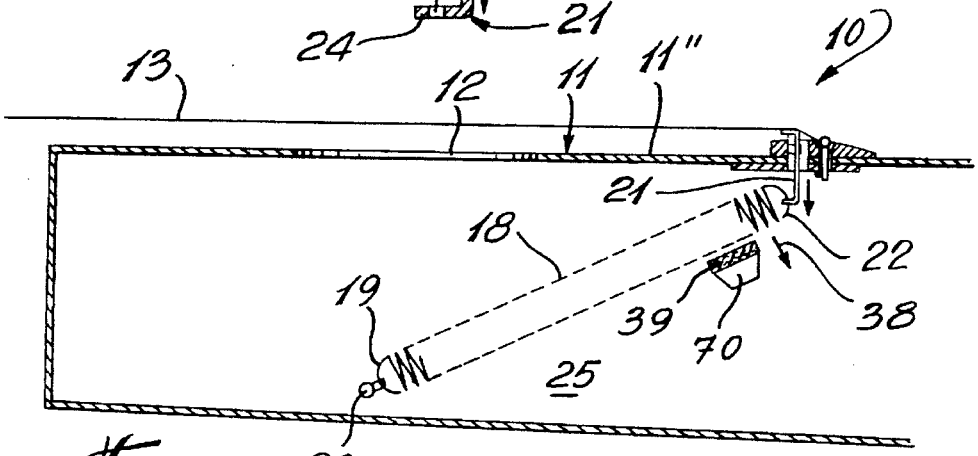
Fig. 3

SOUND REVERBERATOR MOUNTED IN A SOUND BOX OF A STRING MUSICAL INSTRUMENT

CROSS-REFERENCE TO RELATED APPLICATION

This application is a Continuation-in-Part of application Ser. No. 08/401,234, filed on Mar. 9, 1995, which is being abandoned.

TECHNICAL FIELD

The present invention relates to a sound reverberator which is mounted inside the sound box of a stringed musical instrument and wherein springs are connectable to the strings of the instrument to produce sound vibrations internally of the sound box to modify the tonality of the sound generated by the sound box as a result of setting the strings in vibration.

BACKGROUND ART

In our earlier U.S. Pat. No. 4,762,046 issued on Aug. 9, 1988 we describe a sound reverberator device which is provided in a housing which is detachably securable over a top wall of the sound box rearwardly of the bridge piece whereby to produce sound reverberations when the strings of the guitar are set in vibration. We have now found it desirable to produce a permanent sound reverberator inside the sound box of a string musical instrument, such as a guitar, violin, etc. However, this posed a series of difficult technical problems, such as the manner in which the vibrations from the strings can be transferred to the springs internally of the sound box and how the springs can be stopped from vibrating should it be desirable not to have reverberated sound. Because the springs are disposed internally of the sound box another problem was to devise a manner in which the springs can be placed in pre-tension.

SUMMARY OF THE INVENTION

The present invention has resolved the above-mentioned difficulties and provides, according to a broad aspect thereof, a sound reverberator for string musical instruments having a sound box and strings tensioned over a saddle member of a bridge piece connected to a top wall of the sound box. The reverberator comprises one or more pre-tensioned metal springs secured internally of the sound box. A metallic transfer member is secured to a free end of the springs internally of the sound box and is provided with string engaging means at a top end for releasably engaging the strings of the musical instrument to transfer vibrations from the strings to associated ones of the one or more metal springs whereby to produce reverberated sounds internally of the sound box to modify the tonality of the sound generated by the sound box as a result of setting the strings in vibration.

BRIEF DESCRIPTION OF DRAWINGS

A preferred embodiment of the present invention will now be described with reference to the accompanying drawings in which FIG. 1 is a plan view showing a string musical instrument, herein a guitar, equipped with the sound reverberator of the present invention;

FIG. 2 is a fragmented section view showing the manner in which the metallic transfer member is secured in slots of the saddle member and wherein the transfer member is in its disengaged position;

FIG. 3 is a simplified section view of an embodiment of the sound reverberator wherein the springs are secured internally of the sound box in a pre-tension mode;

DESCRIPTION OF PREFERRED EMBODIMENTS

Figure 4:
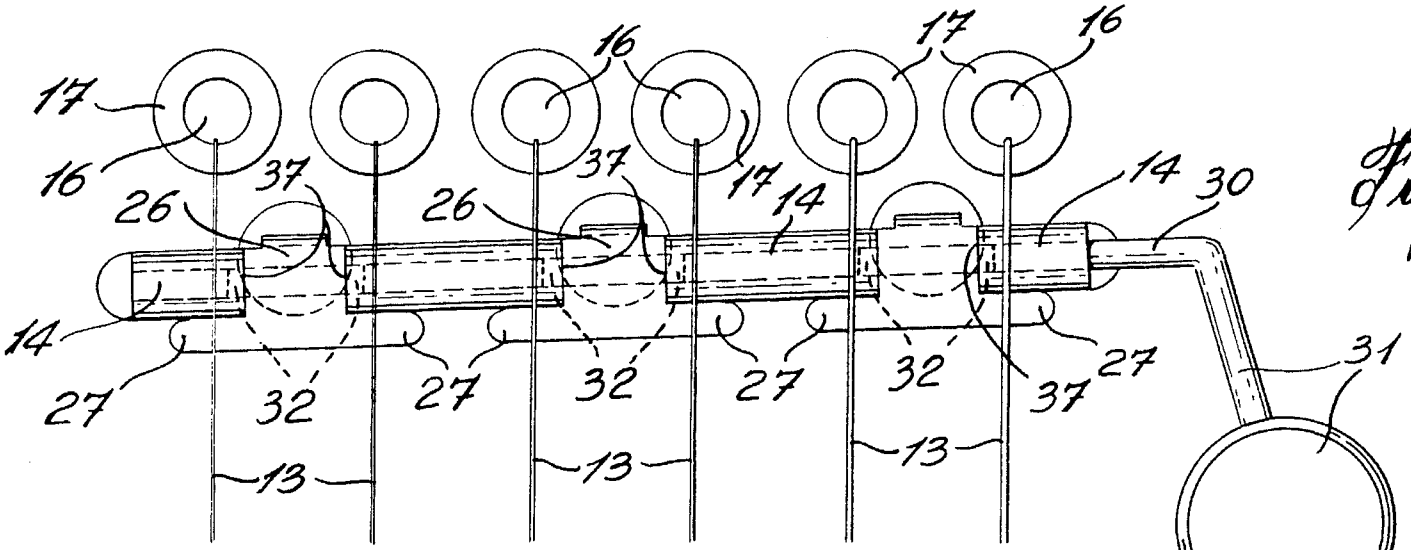
FIG. 4 is a fragmented top view showing the construction of the top end of the metallic transfer member and its position relative to the strings and a finger-actuated displaceable support element secured thereunder.

Referring now to the drawings, and more particularly to FIG. 1 there is shown generally at 10 a guitar string instrument provided with an internal sound reverberator of the present invention. As herein shown, the string instrument 10 is comprised of a sound box 11 having a sound hole 12 and six strings 13 which are held in tension over a saddle member 14 provided on a bridge piece 15. A plurality of pegs 16 retain the connecting ends 13' of the strings 13 within connector bores 17.

Figure 5:
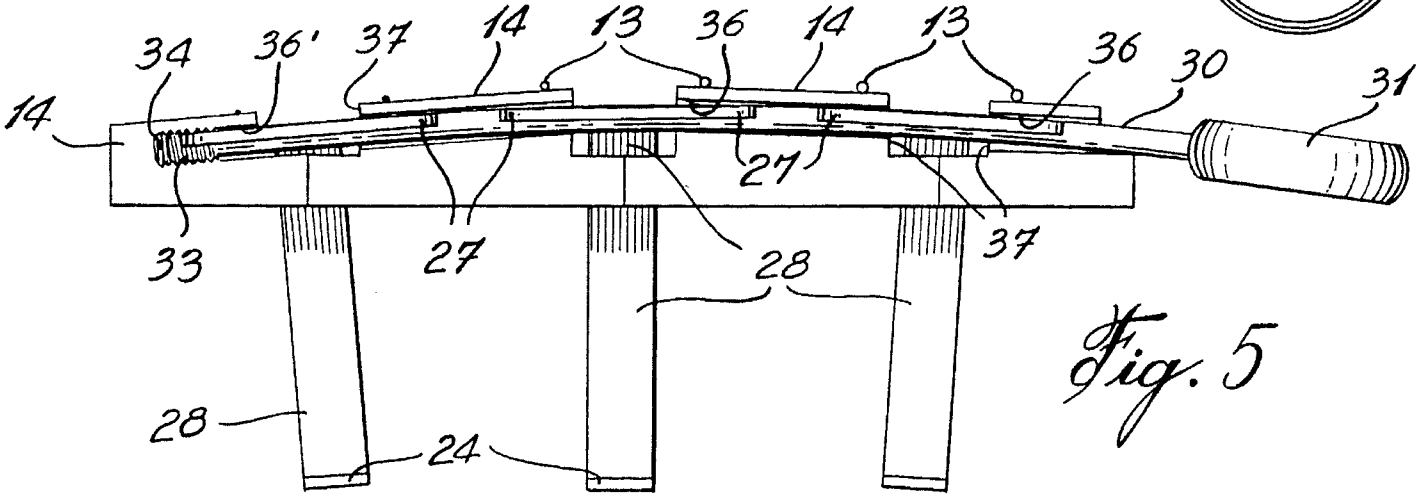
FIG. 5 is a side section view of FIG. 4.

With additional reference to FIGS. 2 to 7, we will now describe the construction of the sound reverberator. As more clearly seen from FIGS. 3 and 7 the sound reverberator is comprised of one or more, herein three metal springs 18, 18' and 18" which are elongated coil springs and secured internally of the sound box at a lower end 19. As shown in FIG. 3 the springs 18 are in pre-tension and are secured at the lower end to a stationary attachment element 20. A metallic transfer member 21, as better shown in FIGS. 2 and 5, is secured to each of the free ends 22 of the springs 18. This is achieved by providing a hole 23 in the connecting flange 24 at the bottom end of the metallic transfer member and disposed in the sound chamber 25 of the sound box 11.

As shown more clearly in FIGS. 2, 4 and 5, the metallic transfer member 21 is an elongated narrow flat metal plate having opposed right angle end flanges 24 and 26 but with the top flange 26 having string engaging means for engagement with the strings 13. The angle top flange 26 is provided at a free end thereof with wings or opposed shoulder sections 27 which project laterally to each side of the metal plate rectangular body 28 and under a respective one of a pair of strings 13, there being three of said pairs of strings in the musical instrument illustrated herein. As shown in FIG. 2 the body 28 of the metallic transfer member 21 is guided in a slot 29 formed in a back wall of the saddle member 14. The right angle end portion or flange 26 is also held captive in a slot 27 provided in the top portion of the saddle member and aligned between each string of the three pairs of strings 13 supported on a cam rod 30 to cause the shoulder sections 27 of the transfer member 21 to engage a pair of strings 13 when displaced thereagainst by axial rotation of the cam rod whereby to transfer vibrations from the strings 13 to the spring 15 connected at its lower end so that the vibrations from the strings are imparted or transferred into the coil spring to cause them to vibrate and generate a reverberation sound to modify the tonality of the sound generated by the strings when they are set in vibration. This reverberating sound emitted by the springs is amplified in the sound chamber 25. As can be seen more clearly in FIG. 3, the transfer member 21 is exerted a downward pull by the spring 18 and biased against the cam rod 30.

As more clearly seen from FIGS. 4 and 5 the cam rod 30 is mounted within the saddle member 14 and is rotatable therein from an engaged position, shown in FIG. 5, to a disengaged position, shown in FIG. 4. In order to impart this axial rotation a lever 31 is provided at a free end of the rod. The cam rod 30 is an elongated soft metal rod of circular cross-section and has bevelled portions 32 therealong on which the top flange 26 rests when the rod is rotated to position the bevelled portions upwardly. This causes the string engaging means 27 to disengage the strings 13 by moving downwardly a limited distance therefrom.

Figure 8:
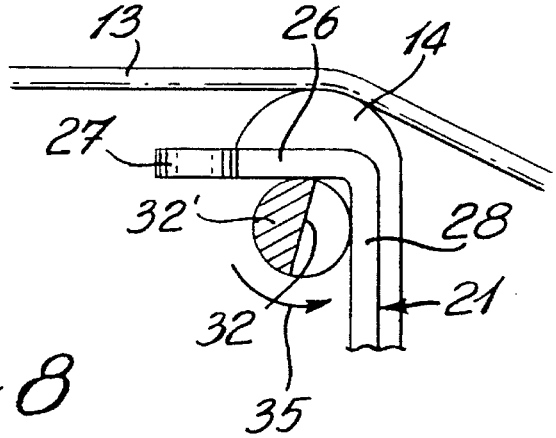
FIG. 8 is a simplified fragmented view showing the relationship between the cam rod and the top flange of the transfer member.

The cam rod 30 as herein shown is constructed of aluminum but other suitable materials may be provided and, as herein shown, this rod 30 arcs when rotated to follow the arc cavities 36 in the saddle member 14. The inner end of the cam rod 30 is also threaded, as shown at 33 and received within a threaded bore 34 formed in the end cavity 36' of the saddle member 14. When the lever 31 is displaced to its "on" position, the top flange string engaging means 26 will be pushed up by the unbevelled section 32' of the cam rod 30, as shown in FIG. 8, whereby to engage the strings 13. When the cam rod is axially rotated in the direction of arrow 35, it will position the bevelled portion 32 under the top flange 26 causing the metal transfer member 21 to move downwardly whereby to disengage the wings or shoulder sections 27 from contact with the pair of strings 13. The longitudinal bore 36 of the saddle member provides sufficient rigidity whereby the rod 30 will flex when rotated within the arcuate bore 36.

As shown in FIG. 3 when the metallic transfer member 21 is its retracted position, see FIG. 2, the coil spring 18 secured to the lower end thereof will move downwardly in the direction of arrow 38 causing the spring 18 to abut against a sound damping cushion piece 39, such as a layer of felt immovably supported thereagainst on a support member 40 whereby to damp vibrations in the spring to stop the reverberation sound. Accordingly, when the lever arm 31 of the cam rod 30 is placed to its "on" position, the spring 18 is displaced away from the cushion piece 39 placing the pre-tension spring 18 in a condition to reverberate sound. Again, when the lever arm 31 is displaced to its "off" position, the reverberation sound is immediately dampened by the damper 39.

Figure 6:
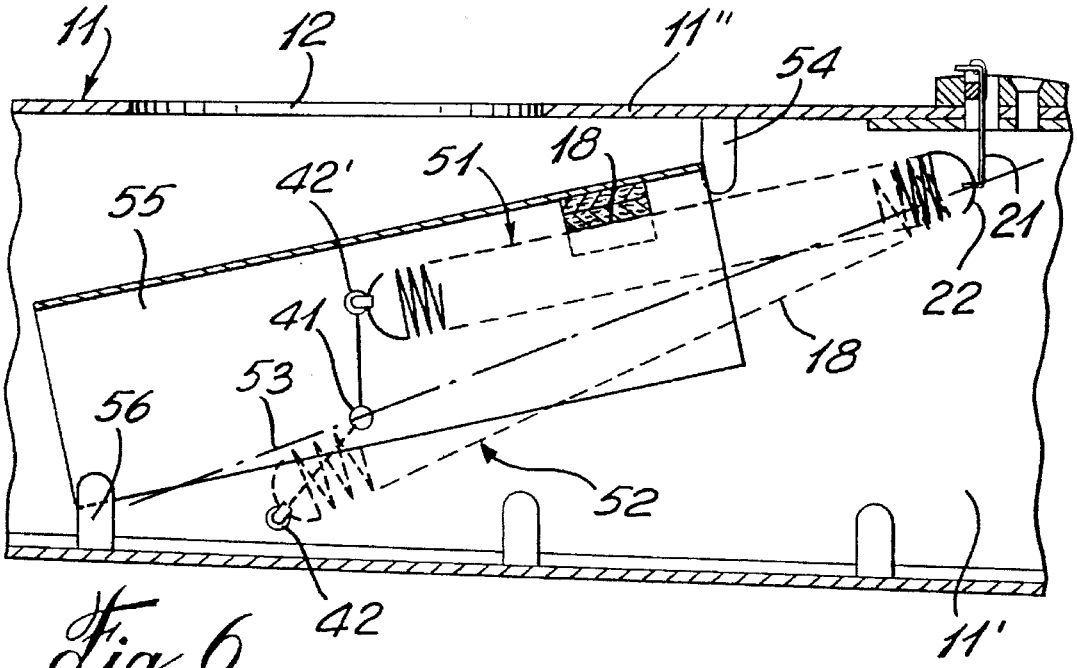
FIG. 6 is a schematic view showing the manner in which the springs are placed in a tensioned engaged position and in a released disengaged position by means of a tensioning connector.
Figure 7:
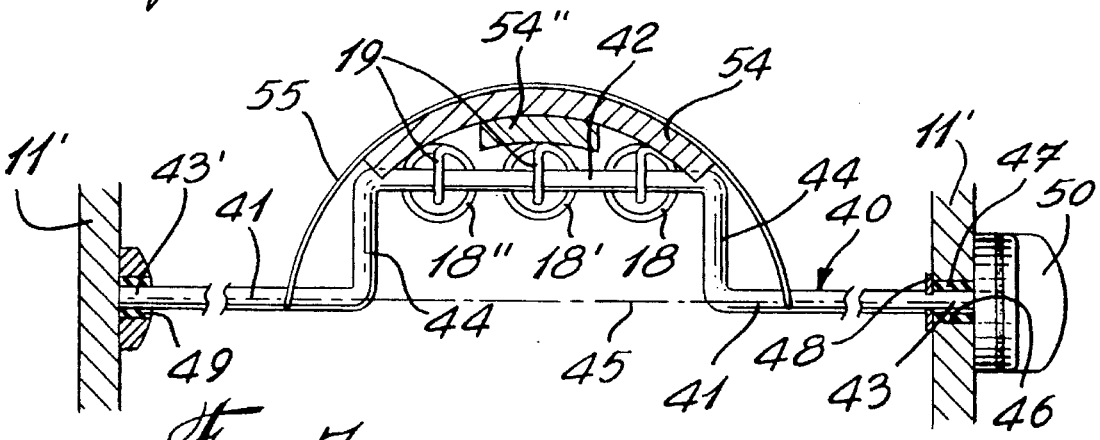
FIG. 7 is a fragmented side view showing the construction of the tensioning connector.

Referring now to FIGS. 6 and 7 there will be described the construction of a tensioning connector 40 which is herein provided, in a preferred embodiment, to place the springs 18 from a natural state to a tension state. As shown in FIG. 7, the tensioning connector 40 is a pivot rod 41 formed with a bridge section 42 intermediate a pair of support points 43 and 43' which are axially aligned transversely of the long axis of the springs. The bridge section 42 is constituted by a U-shaped section of the hinge rod 41 and defines opposed side arms 44 and a bridge arm or bridge member 42 which extends therebetween and spaced substantially parallel to the central longitudinal axis 45 of the rod 41. As shown in FIG. 7 the lower end 19 of the springs 18, 18' and 18" are secured to the bridge member 42 in holes or grooves (not shown) which are equidistantly spaced therealong. The rod 41 extends outwardly of the side wall 11' of the sound box 11 through a hole 46 provided with a bushing 47 therein. An O-ring 48 retains the rod captive between the bushing 47 and an end bushing 49 secured on the inner face of the opposed side wall 11'. Accordingly, the rod 41 may be axially rotated about its central longitudinal axis 45 by turning a finger engaging knob 50 secured to the free end of the rod extending through the bushing 47. This knob 50 is provided with indicating means (not shown) to place the springs in their "off" position of rest, as shown at 51 in FIG. 6, to its tensioned "on" position as shown at 52.

By rotating the rod 41 past the locking axis 53 and on either side thereof, the springs are either locked in their tensioned position, as shown in FIG. 2, and retained therein by the tension in the spring 52. When the bridge member is rotated above the axis 53, the tension in the spring will immediately pull the bridge member 42 to its position at 42' wherein the springs are in a less tensioned state. As also herein shown, when the springs are in their "off" position, as shown at 51, it also engages a sound damping felt block 54' or 54" secured to the underside of an arcuate screen 55'.

The arcuate screen 55 extending under the sound hole 12 whereby to shield the tensioning connector 40 and the springs 18 from the sound hole 12 so that this mechanism is not visible. This shield 55 also has a decorative effect. As herein shown, the shield 55 is support between a pair of support posts 54 and 56. The tensioning connector 40 is also mounted under the sound hole whereby the sound hole provides access to the interior of the sound box whereby the entire mechanism may be repaired or removed through the hole 12.

Figure 9:
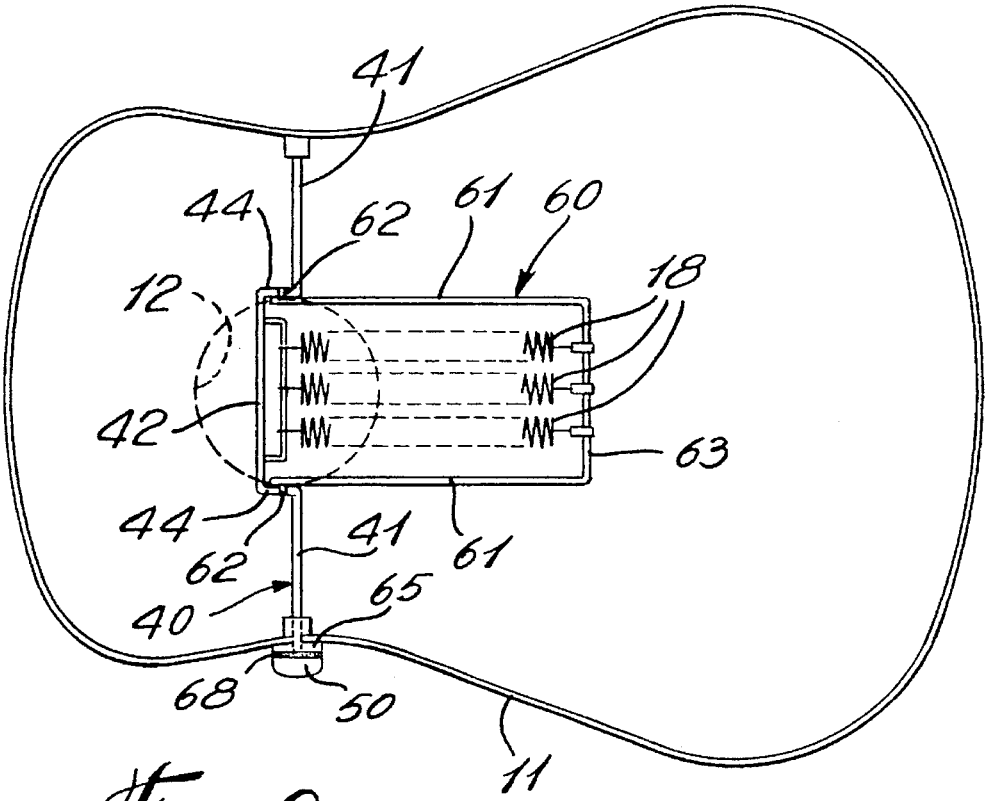
FIG. 9 is a top view of a guitar sound box showing the construction of the guided pusher member secured to the pivot rod for disengaging the string engaging means of the metallic transfer member.
Figure 10:
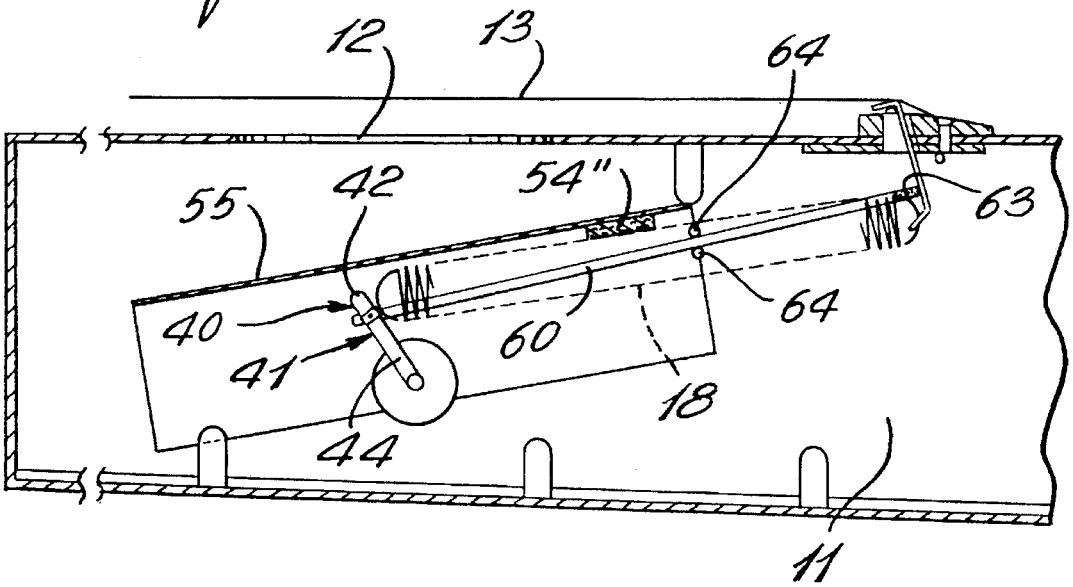
FIG. 10 is a side view illustrating the operation of the guided pusher member when the control knob of the pivot rod is at the off position with the string engaging means of the metallic transfer member disengaged from the strings.
Figure 11:
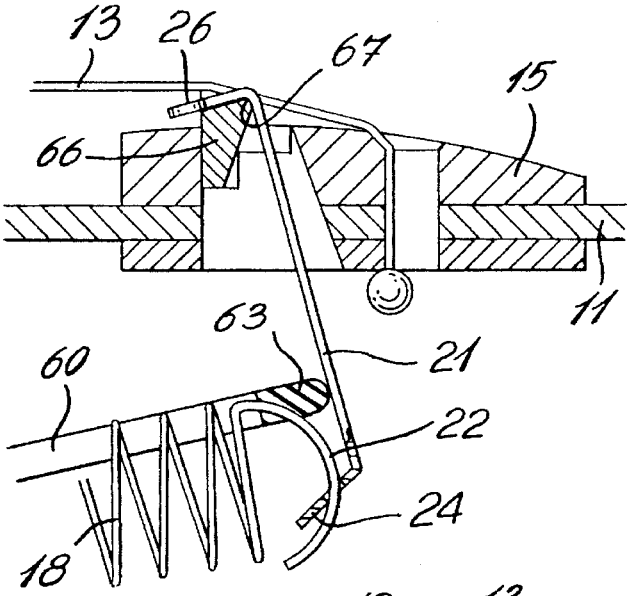
FIG. 11 is an enlarged view showing the string engagement means of the metallic transfer member in its disengaged position with the strings.

Referring now to FIGS. 9, 10 and 11 there will be described a modified tensioning means, similar to that as described for FIGS. 6 to 8 but incorporating a pusher member. As hereinshown, the tensioning connector 40 has a guided pusher member 60 secured to the side arms 44 of the bridge arm 42 and pivotally connected thereto. The pusher member 60 is a U-shaped pusher rod having a pair of spaced parallel arms 61 which are pivotally connected by pivot pins 62 to the side arms 44 of the U-shaped bridge section 42. The arms 60 are pivotally connected to a respective one of the side arms 44. A transverse pusher arm 63 is formed at a free end of the pusher member and is guided in a slot defined between a pair of parallel guide rods 64 which are secured across the screen member 55 as clearly illustrated in FIG. 10.

Figure 12:
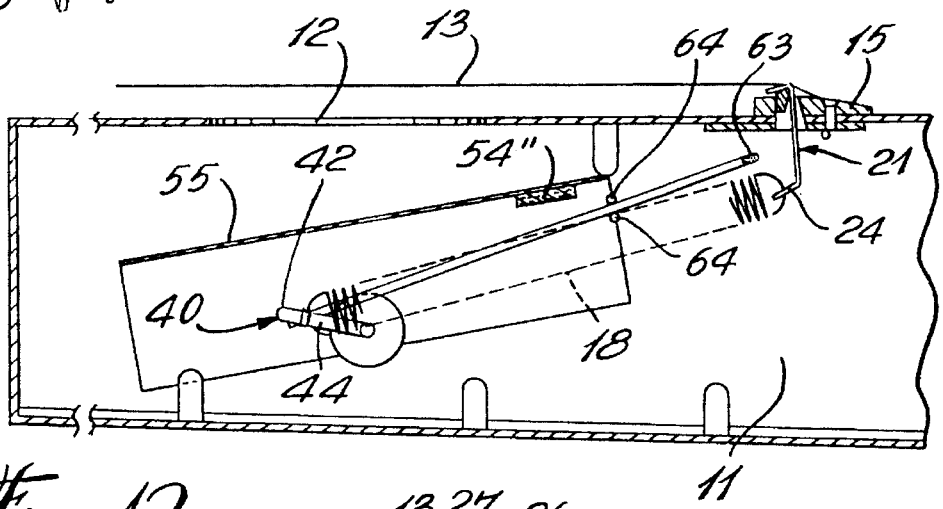
FIG. 12 is a side view similar to FIG. 10 but showing the connector at an intermediate position where the springs are stretched less than at the engaged position.
Figure 14:
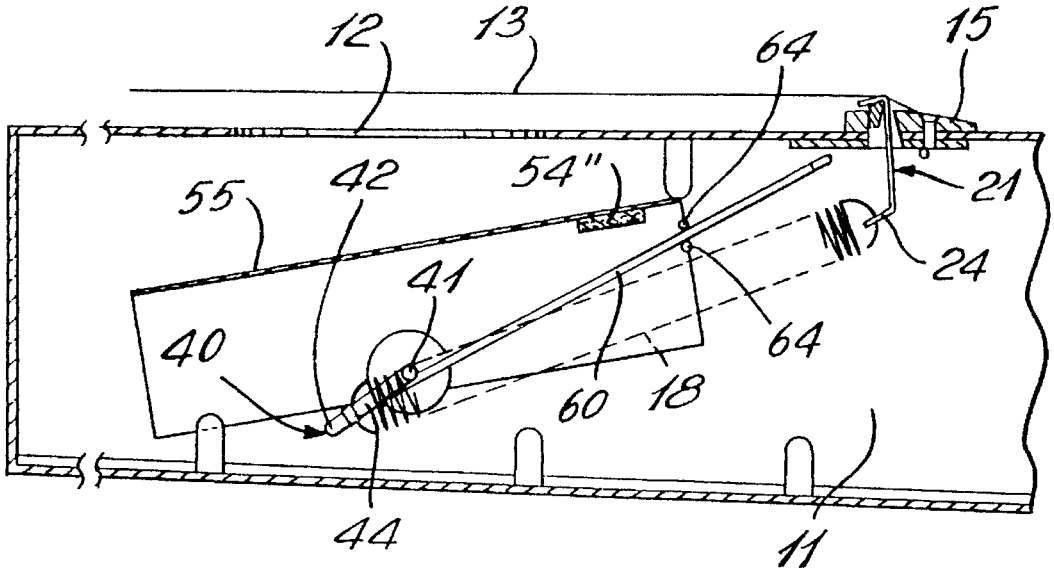
FIG. 14 is a side view similar to FIGS. 10 and 12 but showing the connector at an engaged position where the springs are tensioned to their maximum and the spring engagement means of the metallic transfer member in engagement with the strings.

The finger engaging knob 50 is secured to the pivot rod 41 exteriorly of the sound box 11 on a bass 65 and is rotatable to three distinct positions, and namely an off position, as illustrated in FIG. 10, a disengaged position, as illustrated in FIG. 14 and an intermediate position, as illustrated in FIG. 12.

As shown in FIGS. 10 and 11, the saddle member 66 is formed differently than that as described in the previous embodiments and is also provided with three transverse slots, as previously described in a top section thereof but a pivoting ridge 67 of triangular shape is formed in the rear end of the slot and on which the top end flange 26 of the metallic transfer member 21 is held captive between the strings and the top surface of the slots. The lower end 24 of the transfer member is connected to the hook end 22 of the coil springs 18 as previously described.

As shown in FIGS. 10 and 11 when the finger engaging knob 50 is placed at its off position, the tensioning connector 40 is pivoted forwardly causing the pusher member 60 to advance to its foremost position and its transverse pusher arm 63 pushing against the metallic transfer member 21 causing the string engaging top flange 26 to pivot downwardly out of contact with the strings 13.

Figure 13:
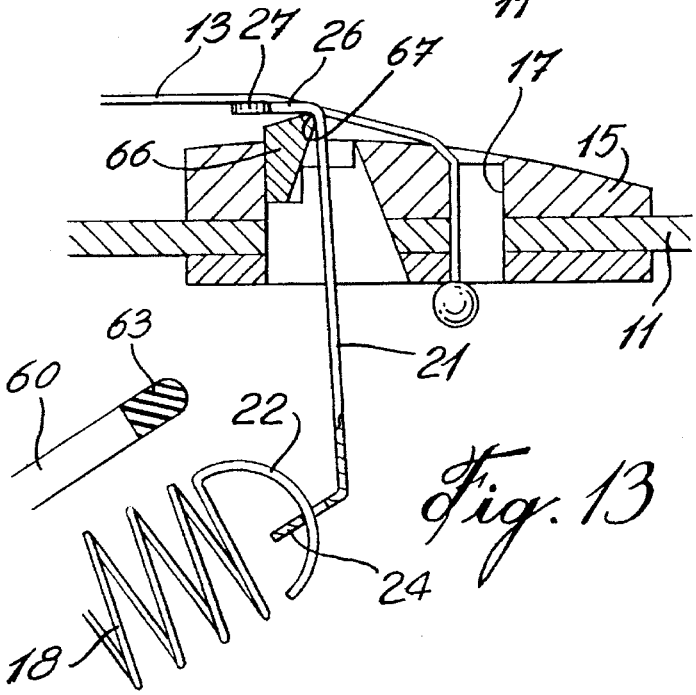
FIG. 13 is an enlarged view showing the string engagement means of the metallic transfer member partially touching the strings.

With specific reference now to FIGS. 12 and 13 there is shown the intermediate position of the tensioning connector 40 and wherein the springs 18 are slightly stretched and the transverse string engaging flange 26 partially contacting the strings 13. In this position only a part of the sound will be transmitted into the springs to cause the springs to emit an intermediate reverberation sound. It can also be seen that the pusher member 60 is retracted and disengaged from the metallic transfer member 21.

Figure 15:
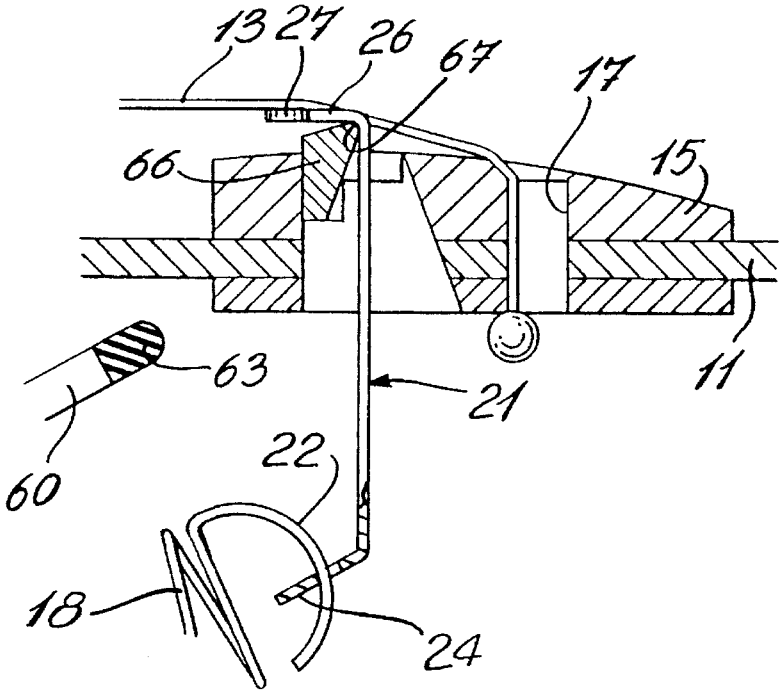
FIG. 15 is an enlarged view illustrating the string engagement means in contact with the strings.

Referring now to FIGS. 14 and 15, there is shown the tensioning connector 40 at its full reverberation position wherein the springs 18 are stretched to the maximum position of stretch and the pusher member 60 remaining in a retracted position. In this position the springs 18 apply a pulling force to the connecting flange 24 of the metallic transfer member 21 and the spring engaging top flange 26 is firmly biased against the underside of the strings 13 from its pivot point on the pivot ridge 67. When the strings are placed in vibration, the vibration is transmitted to the springs 18 which emit a reverberation sound inside the sound box 11. As can be seen in this position the bridge member 42 is below the pivot rod 41 maintaining the springs in tension and preventing disconnection. When the tensioning knob 50 is displaced to its intermediate position as shown in FIG. 12, the springs are maintained in tension by a position arresting means (not shown) disposed between the base 65 and the knob 50 adjacent their mating surfaces as indicated generally at 68 in FIG. 9. This arresting means may be provided by friction surfaces or shallow ridges in one piece disposed in shallow grooves of the other piece, or any other obvious means. When the knob is rotated to the off position, shown in FIG. 10, the spring draws the tensioning connector 40 forwardly to tilt the metallic transfer member 21 to disengage with the strings, as more clearly illustrated in FIG. 11.

It is within the ambit of the present invention to cover any obvious modifications of the preferred embodiment described herein, provided such modifications fall within the scope of the appended claims.

We claim:

1. A sound reverberator for a string musical instrument having a sound box and strings tensioned over a saddle member of a bridge piece connected to a top wall of said sound box, said reverberator comprising one or more pre-tensioned metal springs secured internally of said sound box, a metallic transfer member secured to a free end of said springs internally of said sound box, said transfer member having string engaging means at a top end for releasably engaging said strings of said musical instrument to transfer vibrations from said strings to associated ones of said one or more metal springs to produce reverberated sounds internally of said general sound box to modify the tonality of sound generated by said sound box as a result of setting the strings in vibration.

2. A sound reverberator as claimed in claim 1 wherein there is further provided tensioning means to pre-tension said one or more metal springs, said tensioning means being a displaceable tensioning connector to which an opposed end of said springs are secured, said connector being displaceable from a disengaged position where said springs are substantially un-tensioned and said string engaging means are released from touching said strings, to an engaged position where said springs are stretched and said string engaging means touches said strings.

3. A sound reverberator as claimed in claim 2 wherein said connector is also displaceable to an intermediate position where said springs are stretched less than at said engaged position and said string engaging means partially touches said strings.

4. A sound reverberator as claimed in claim 2 wherein there is further provided disengagement means to disengage said string engaging means of said metallic transfer member from said strings, said disengagement means being connected to said tensioning means and displaceable thereby so that said disengagement means engages said metallic transfer member when said tensioning connector is displaced to said disengaged position.

5. A sound reverberator as claimed in claim 4 wherein said metallic transfer member is an elongated flat metal plate, said metal plate having an inner end for engagement with said free end of said springs, said string engaging means being an angled outer end portion of said metal plate and having opposed wing sections extending under a respective one of a pair of said strings.

6. A sound reverberator as claimed in claim 5 wherein said saddle member is provided with three transverse slots in a top section thereof, said angled end portion of said elongated flat metal plate being disposed within one of said transverse slots and resting over a pivoting ridge portion of said saddle member, said metal plate pivoting on said pivoting ridge by the tensioning of said springs and displacement by said disengagement means.

7. A sound reverberator as claimed in claim 4 wherein said tensioning connector is a pivot rod pivotably secured at spaced support points, a bridge member intermediate said support points and spaced from a central longitudinal axis of said hinged rod passing through said support points, said rod having finger engageable means at a free end thereof disposed externally of said sound box to impart limited axial rotation of said hinged rod from said disengaged position where said springs are substantially non-tensioned to said engaged position where said springs are stretched.

8. A sound reverberator as claimed in claim 7 wherein said bridge member is constituted by a U-shaped sections of said hinged rod, said U-shaped section defining opposed side arms and a bridge arm therebetween and spaced substantially parallel to said central longitudinal axis, said opposed end of said springs being secured to said bridge arm.

9. A sound reverberator as claimed in claim 7 wherein said string engaging means is a guided pusher member pivotally secured to said bridge member and having an abutting free end for pushing abutment against an inner end of said metallic transfer member.

10. A sound reverberator as claimed in claim 9 wherein said guided pusher member is a U-shaped pusher rod having a pair of spaced parallel arms pivotally connected at a free end to a respective one of said side arms of said bridge member, and a transverse pusher arm for said pushing abutment, said parallel arms being guided in a slot defined between a pair of parallel guide rods secured to a screw member disposed above said springs.

11. A sound reverberator as claimed in claim 1 wherein there are two or more of said pre-tensioned springs, said springs being elongated coiled springs, there being further provided sound damping means in contact with said springs when said string engaging means of said transfer member is positioned spaced below said strings.

12. A sound reverberator as claimed in claim 4 wherein there is further provided sound damping means in contact with each said springs when said springs are positioned at said disengaged position.

13. A sound reverberator as claimed in claim 1 wherein said musical instrument is a six-string guitar having a sound hole in a top wall of said sound box, and a screen disposed internally of said sound box spaced below said sound hole and spaced above said springs.

14. A sound reverberator as claimed in claim 7 wherein a finger engageable means is secured to said pivot exteriorly of said sound box and a control knob secured to said pivot exteriorly of said sound box and having a three position setting to rotate said pivot rod to said disengaged, engaged and a further intermediate position where said strings are stretched less than at said engaged position and said string engaging means partially touches said strings.

* * * * *